US006923141B1

(12) United States Patent
Staats et al.

(10) Patent No.: US 6,923,141 B1
(45) Date of Patent: Aug. 2, 2005

(54) FLAG SUPPORT ASSEMBLY

(76) Inventors: Robert A. Staats, 28385 Jelloway Rd., Danville, OH (US) 43014; Kevin T. Staats, 28385 Jelloway Rd., Danville, OH (US) 43014; Brandon T. Boeshart, 23303 Danville Amity Rd., Danville, OH (US) 43014-9658

( * ) Notice: Subject to any disclaimer, the term of this patent is extended or adjusted under 35 U.S.C. 154(b) by 0 days.

(21) Appl. No.: 10/768,553

(22) Filed: Feb. 2, 2004

(51) Int. Cl.[7] ..... G09F 17/00

(52) U.S. Cl. ..... 116/173; 116/174; 40/603; 248/121

(58) Field of Search ..... 116/173, 174, 116/28 R, 209; 40/603, 604, 218; 248/121, 125.8

(56) References Cited

U.S. PATENT DOCUMENTS

| | | | | | |
|---|---|---|---|---|---|
| 1,302,190 | A | * | 4/1919 | McCormack | 116/173 |
| 1,317,445 | A | * | 9/1919 | Hoffman | 116/173 |
| 1,448,299 | A | | 3/1923 | Holliday | |
| 1,476,426 | A | * | 12/1923 | Short | 116/174 |
| 1,646,467 | A | * | 10/1927 | Walton | 116/174 |
| 2,368,783 | A | | 2/1945 | Schillinger | |
| 2,452,842 | A | * | 11/1948 | Davis | 116/173 |
| 3,850,401 | A | * | 11/1974 | Snediker | 248/292.13 |
| 5,694,733 | A | | 12/1997 | Gallemore, II | |
| 5,697,321 | A | | 12/1997 | Dobbins | |
| 5,884,578 | A | | 3/1999 | Thostrup | |
| 6,138,978 | A | * | 10/2000 | Andersen | 248/534 |
| 2002/0073914 | A1 | | 6/2002 | Kinahan | |
| 2003/0010274 | A1 | | 1/2003 | McCudden et al. | |

* cited by examiner

*Primary Examiner*—Christopher W. Fulton
*Assistant Examiner*—Tania Courson

(57) ABSTRACT

A flag assembly includes a base having a substantially planar bottom portion and an opening disposed medially thereof. The assembly further includes an elongated flagpole removably engageable with the opening. A plurality of brackets are connected adjacent an upper portion of the flagpole and an elongated arm is pivotally connected to one of the plurality of brackets. The assembly further includes a support shaft having first and second end portions with the first end portion being pivotally connected to the elongated arm and the second end portion being removably connected to another one of the plurality of brackets. A plurality of flag clamps are connected to the upper portion of the flagpole and the elongated arm for removably clamping a flag.

18 Claims, 4 Drawing Sheets

FLAG SUPPORT ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flag support assemblies and, more particularly, to a flag support assembly that maintains the flag in a taut, fully extended position.

2. Prior Art

The display of flags, ribbons, signs, banners and the like dates back into ancient times. For centuries, banners have been simply supported from walls, ceilings and rigid poles for a variety of decorative and aesthetic reasons. Today, banners, signs and flags are supported from a myriad of structures for, likewise, a variety of purposes. In addition, flags, banners and signs are used today for commercial advertisement and, thus, the economic importance of effective flag/banner displays has increased. Sign/flag/banner structures are now specifically designed for the most prominent, convenient and aesthetically pleasing presentation possible to the purchasing public.

The widespread use of flags/banners/billboards and related creative signage for commercial advertising has necessitated structural innovation. The size, shape and orientation of the flag/banner/sign is extremely important to the advertiser because the flag/banner sign assemblies are sold for the purpose of gaining the public's attention and often valued at their effectiveness. The display area itself must then maintain the appropriate orientation for display to the public, and it must withstand the forces of nature. In this regard, It is often advantageous to maintain the flag/banner/sign in a taut condition, properly oriented to the eyes of the viewing public. Problems occur when wind and other natural forces cause the flag/banner/sign to become rumpled, wrinkled, disoriented, and otherwise unattractively displayed about its support structure. Wind is, of course, a constant force with regard to a flag/banner or similar flaccid sign systems.

The present invention overcomes certain problems of prior art flag/banner display structures by providing a system adapted for maintaining appropriate support for the flag/banner thereon with an assembly that is both economical to fabricate and easy to install. In addition, it would be an advantage to provide a lightweight, inexpensive flag/banner/sign display apparatus that maintains an orientation that is less likely to wrinkle or become dislodged in high winds.

Accordingly, a need remains for a flag support assembly that maintains a flag in a taut, fully extended position.

BRIEF SUMMARY OF THE INVENTION

In view of the foregoing background, it is therefore an object of the present invention to provide an assembly for maintaining flags in a taut, fully extended position. These and other objects, features, and advantages of the invention are provided by a flag support assembly including a base having a substantially planar bottom portion and an upper portion integral therewith. Such an upper portion has an opening disposed medially thereof and includes a threaded inner surface. The assembly further includes an elongated flagpole having an upper portion and a threaded lower portion telescopically connected thereto and removably engageable with the opening so that the flagpole can be maintained at a substantially vertical position.

A plurality of brackets are connected adjacent the upper portion of the flagpole and spaced along a length thereof and an elongated arm is pivotally connected to one of the plurality of brackets. The assembly further includes a support shaft having first and second end portions with the first end portion being pivotally connected to the elongated arm and the second end portion being removably connected to another one of the plurality of brackets.

The elongated flagpole may include a plurality of telescopic sections slidably engageable with each other and may also include a plurality of flag clamps formed of spring steel and connected to one of the plurality of telescopic sections for removably clamping a flag thereto. One of the plurality of brackets is positioned above another one of the plurality of brackets.

The elongated arm may include a female section and a male section telescopically movable within the female section and along a substantially parallel path thereto. A plurality of flag clamps are preferably spaced along the elongated arm for receiving a flag. The plurality of flag clamps may include a substantially arcuate portion positionable about the elongated flagpole and the elongated arm and may further include a plurality of substantially resilient arms integral with the arcuate portion.

The plurality of brackets include a plurality of members having opposed end portions including a plurality of apertures and a substantially arcuate portion disposed medially therebetween and about the flagpole respectively. Another one of the plurality of brackets includes a substantially arcuate portion positioned about the flagpole and includes a notch integral with the arcuate portion for receiving the second end portion of the support shaft.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, this embodiment is provided so that this application will be thorough and complete, and will fully convey the true scope of the invention to those skilled in the art.

Figure 1:
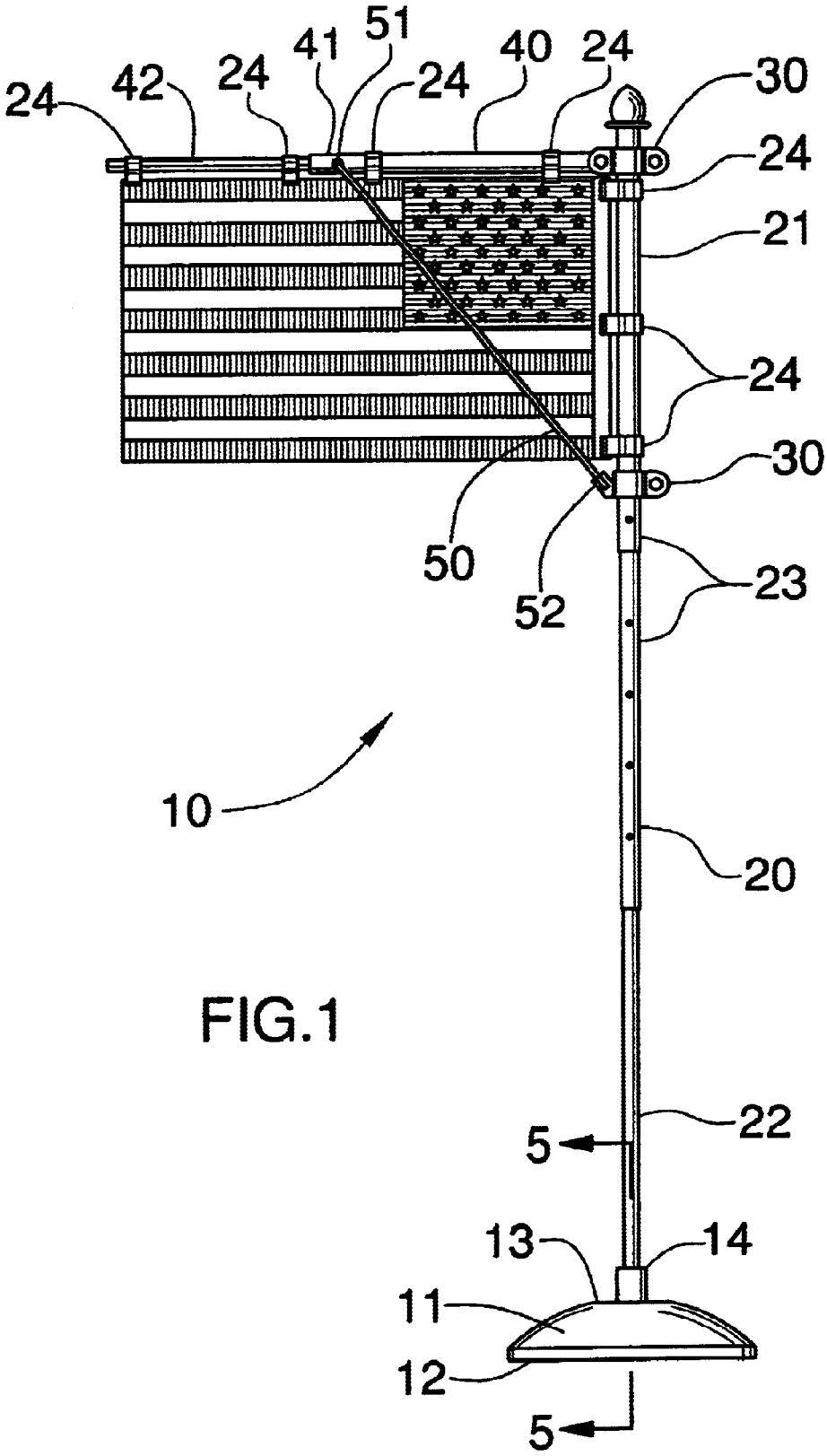
FIG. 1 is a side elevational view showing a flag support assembly, in accordance with the present invention.
Figure 2:
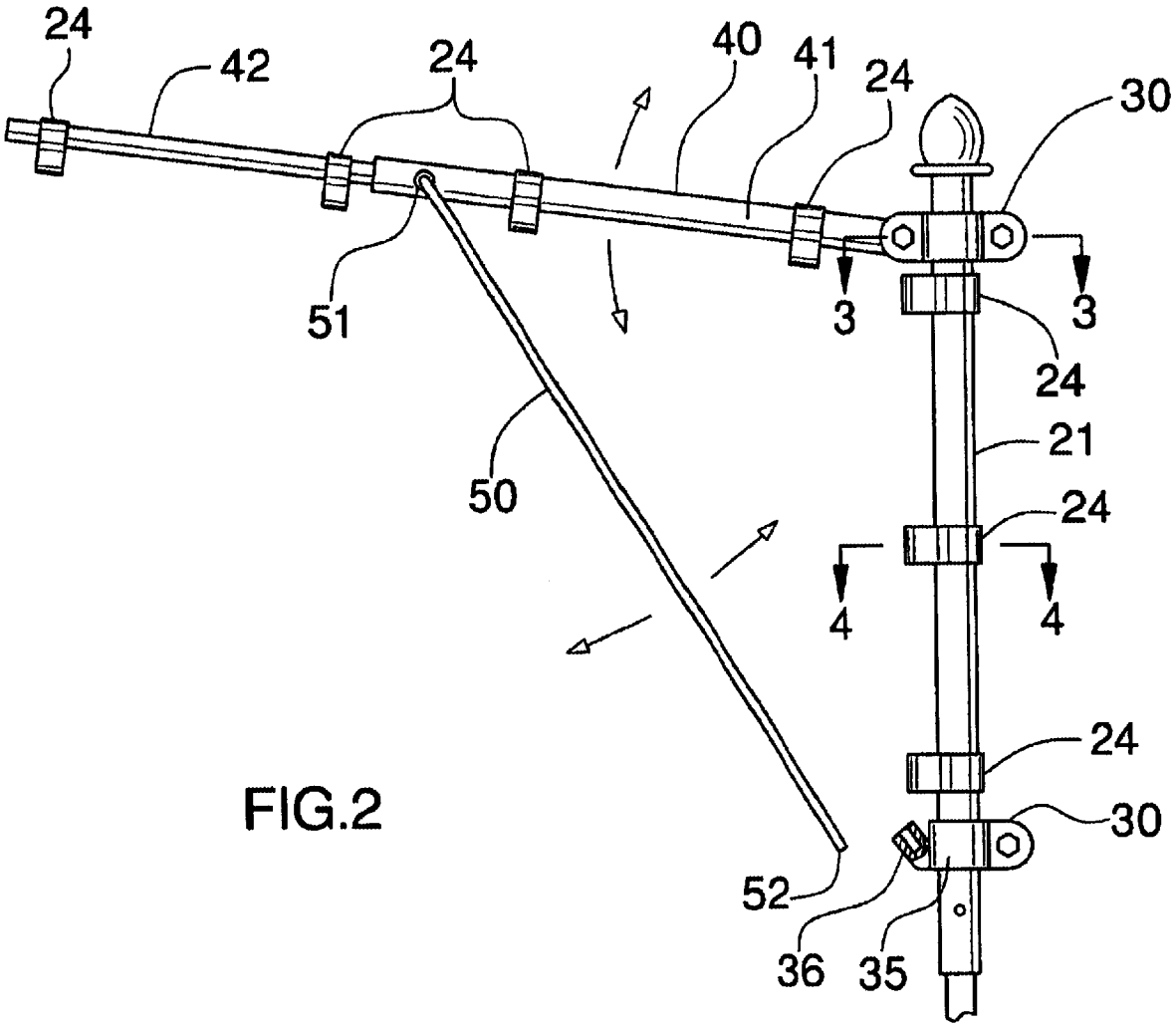
FIG. 2 is an enlarged, partial side elevational view of FIG. 1.
Figure 3:
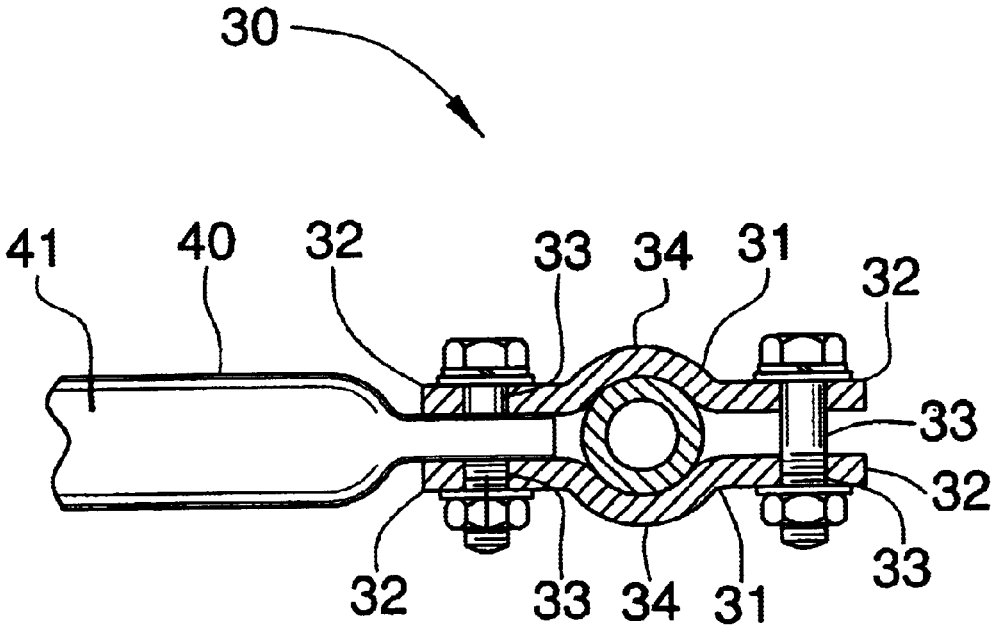
FIG. 3 is a cross-sectional view of a bracket, taken along line 3—3 in FIG. 2.
Figure 4:
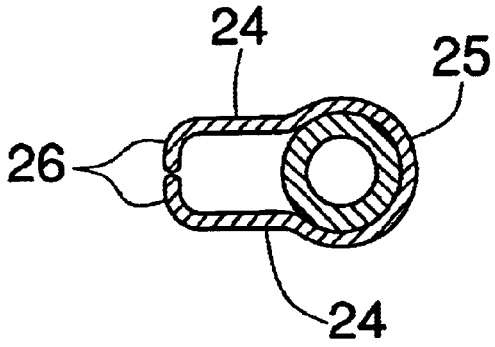
FIG. 4 is a cross-sectional view of a flag clamp, taken along line 4—4 in FIG. 2.
Figure 5:
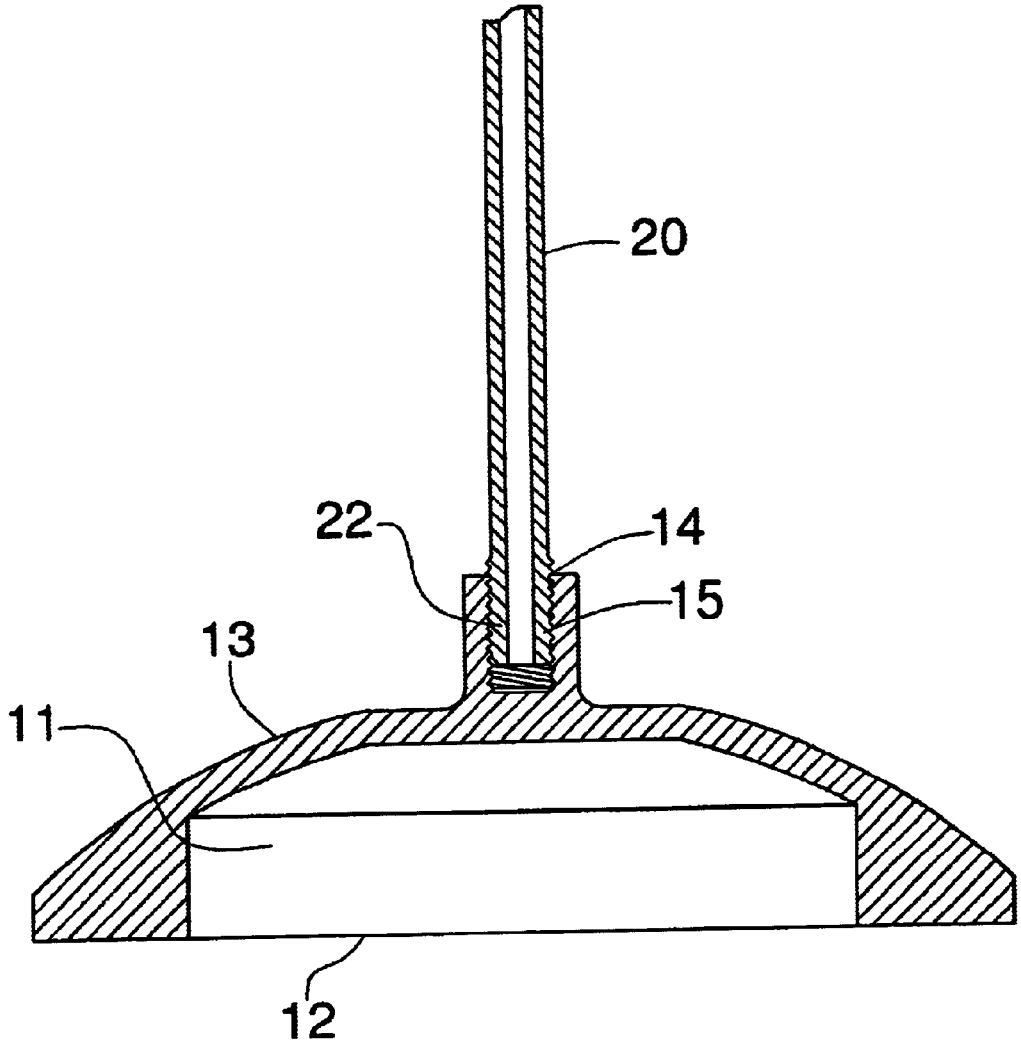
FIG. 5 is an enlarged cross-sectional view of the base shown in FIG. 1, taken along line 5—5.

The assembly of this invention is referred to generally in FIGS. 1–5 by the reference numeral 10 and is intended to provide a flag support assembly. It should be understood that the assembly 10 may be used to support many different types of flags, pennants, and other signs and banners and should not be limited to supporting only flags.

The assembly 10 includes a base 11 having a substantially planar bottom portion 12 and an upper portion 13 integral therewith and having an opening 14 disposed medially thereof and including a threaded inner surface 15. The assembly 10 further includes an elongated flagpole 20 having an upper portion 21 and a threaded lower end portion 22 telescopically connected thereto and removably engageable with the opening 14 so that the flagpole 20 can be maintained at a substantially vertical position. The base 11 provides a stable platform for the flagpole 20, enabling it to remain in a substantially vertical position in windy conditions. The flagpole 20 is preferably formed of aluminum because of its light weight, durability and resistance to corrosion, but may be formed of plastic or steel. Advantageously, the assembly 10 may also be used in indoor environments to display flags or advertising banners.

A plurality of brackets 30 are connected adjacent the upper portion 21 of the flagpole 20 and spaced along a length thereof and an elongated arm 40 is pivotally connected to one of the plurality of brackets 30. The assembly 10 further includes a support shaft 50 having first 51 and second 52 end portions with the first end portion 51 pivotally connected to the elongated arm 40 and the second end portion 52 removably connected to another one of the plurality of brackets 30.

The elongated flagpole 20 includes a plurality of telescopic sections 23 slidably engageable with each other and having a plurality of flag clamps 24 formed of spring steel connected to one of the plurality of telescopic sections 23 for removably clamping a flag thereto. The telescopic feature of the flagpole 20 enables the height of the flagpole 20 to be adjusted to accommodate the different ceiling heights of indoor rooms. One of the plurality of brackets 30 is positioned above another of the plurality of brackets 30.

The elongated arm 40 includes a female section 41 and a male section 42 telescopically movable within the female section 41 and along a substantially parallel path thereto. This enables the elongated arm 40 to display flags and banners of varying lengths while maintaining the tautness of the flag or banner. A plurality of flag clamps 24 are spaced along the elongated arm 40 for receiving a flag. The plurality of brackets 30 include a plurality of members 31 having opposed end portions 32 including a plurality of apertures 33 and a substantially arcuate portion 34 disposed medially therebetween and about the flagpole 20 respectively.

Another one of the plurality of brackets 30 includes a substantially arcuate portion 35 positioned about the flagpole 20 and a notch 36 integral with the arcuate portion 35 and for receiving the second end portion 52 of the support shaft 50. The plurality of flag clamps 24 include a substantially arcuate portion 25 positionable about the elongated flagpole 20 and the elongated arm 40 and a plurality of substantially resilient arms 26 integral with the arcuate portion 25. The resilient arms 26 enable the assembly 10 to display flags of varying thicknesses and material, such as cloth or vinyl well known in the sign and banner industry, while maintaining a firm grip thereon.

The assembly 10 ensures that flags and banners are attractively displayed at all times and may be used inside or outside of homes and commercial buildings. The features of the assembly 10 ensure that the flag is fully extended and provides the appearance of waving in the breeze instead of drooping. The assembly 10 also prevents the flag from wrapping around the flagpole in windy conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A flag support assembly comprising:

a base having a substantially planar bottom portion and an upper portion integral therewith, said base further having an opening disposed medially thereof and including a threaded inner surface;

an elongated flagpole having an upper portion and a threaded lower portion telescopically connected thereto and removably engageable with said opening so that said flag pole can be maintained at a substantially vertical position;

a plurality of brackets connected to said flagpole and spaced along a length thereof, said plurality of brackets being connected adjacent said upper portion of said flagpole;

an elongated arm pivotally connected to one said plurality of brackets; and a support shaft having first and second end portions pivotally connected to said elongated arm and removably connected to another said plurality of brackets respectively.

2. The flag support assembly of claim 1, wherein said elongated flagpole comprises:

a plurality of telescopic sections slidably engageable with each other;

said one plurality of brackets being positioned above said another plurality of brackets; and a plurality of flag clamps connected to one said plurality of telescopic sections and for removably clamping a flag thereto.

3. The flag support assembly of claim 2, wherein said plurality of flag clamps comprise:

a substantially arcuate portion positionable about said elongated flagpole and said elongated arm; and a plurality of substantially resilient arms integral with said arcuate portion.

4. The flag support assembly of claim 2, wherein said plurality of flag clamps are formed from spring steel.

5. The flag support assembly of claim 1, wherein said elongated arm comprises:

a female section;

a male section telescopically movable within said female section and along a substantially parallel path thereto; and a plurality of flag clamps spaced along said elongated arm and for receiving a flag.

6. The flag support assembly of claim 1, wherein said one plurality of brackets comprises:

a plurality of members having opposed end portions including a plurality of apertures and a substantially arcuate portion disposed medially therebetween and about said flagpole respectively.

7. The flag support assembly of claim 1, wherein said another plurality of bracket comprises:

an arcuate portion positioned about said flagpole; and a notch integral with said arcuate portion and for receiving said second end portion of said support shaft.

8. A flag support assembly comprising:

a base having a substantially planar bottom portion and an upper portion integral therewith, said base further having an opening disposed medially thereof and including a threaded inner surface;

an elongated flagpole having an upper portion and a threaded lower portion telescopically connected thereto and removably engageable with said opening so that said flag pole can be maintained at a substantially vertical position, said elongated flagpole including a plurality of telescopic sections slidably engageable with each other, said one plurality of brackets being positioned above said another plurality of brackets, and a plurality of flag clamps connected to one said plurality of telescopic sections and for removably clamping a flag thereto;

a plurality of brackets connected to said flagpole and spaced along a length thereof, said plurality of brackets being connected adjacent said upper portion of said flagpole;

an elongated are pivotally connected to one said plurality of brackets; and a support shaft having first and second end portions pivotally connected to said elongated arm and removably connected to another said plurality of brackets respectively.

9. The flag support assembly of claim 8, wherein said elongated arm comprises:

a female section;

a male section telescopically movable within said female section and along a substantially parallel path thereto; and a plurality of flag clamps spaced along said elongated arm and for receiving a flag.

10. The flag support assembly of claim 9, wherein said plurality of flag clamps comprise:

a substantially arcuate portion positionable about said elongated flagpole and said elongated arm; and a plurality of substantially resilient arms integral with said arcuate portion.

11. The flag support assembly of claim 9, wherein said plurality of flag clamps are formed from spring steel.

12. The flag support assembly of claim 8, wherein said one plurality of brackets comprises:

a plurality of members having opposed end portions including a plurality of apertures and a substantially arcuate portion disposed medially therebetween and about said flagpole respectively.

13. The flag support assembly of claim 8, wherein said another plurality of bracket comprises:

an arcuate portion positioned about said flagpole; and a notch integral with said arcuate portion and for receiving said second end portion of said support shaft.

14. A flag support assembly comprising:

a base having a substantially planar bottom portion and an upper portion integral therewith, said base further having an opening disposed medially thereof and including a threaded inner surface;

an elongated flagpole having an upper portion and a threaded lower portion telescopically connected thereto and removably engageable with said opening so that said flag pole can be maintained at a substantially vertical position, said elongated flagpole including a plurality of telescopic sections slidably engageable with each other, said one plurality of brackets being positioned above said another plurality of brackets, and a plurality of flag clamps connected to one said plurality of telescopic sections and for removably clamping a flag thereto;

a plurality of brackets connected to said flagpole and spaced along a length thereof, said plurality of brackets being connected adjacent said upper portion of said flagpole;

an elongated arm pivotally connected to one said plurality of brackets, said elongated arm including a female section, a male section telescopically movable within said female section and along a substantially parallel path thereto, and a plurality of flag clamps spaced along said elongated arm and for receiving a flag; and a support shaft having first and second end portions pivotally connected to said elongated arm and removably connected to another said plurality of brackets respectively.

15. The flag support assembly of claim 14, wherein said one plurality of brackets comprises:

a plurality of members having opposed end portions including a plurality of apertures and a substantially arcuate portion disposed medially therebetween and about said flagpole respectively.

16. The flag support assembly of claim 14, wherein said another plurality of bracket comprises:

an arcuate portion positioned about said flagpole; and a notch integral with said arcuate portion and for receiving said second end portion of said support shaft.

17. The flag support assembly of claim 14, wherein said plurality of flag clamps comprise:

a substantially arcuate portion positionable about said elongated flagpole and said elongated arm; and a plurality of substantially resilient arms integral with said arcuate portion.

18. The flag support assembly of claim 17, wherein said plurality of flag clamps are formed from spring steel.

* * * * *

UNITED STATES PATENT AND TRADEMARK OFFICE

CERTIFICATE OF CORRECTION

PATENT NO. : 6,923,141 B1 
DATED : August 2, 2005
INVENTOR(S) : Roberta A. Staats, Kevin Staats and Brandon T. Boeshart It is certified that error appears in the above-identified patent and that said Letters Patent is hereby corrected as shown below:

Title page,
Item [76], Inventors, change "Robert" to -- Roberta --.

Signed and Sealed this

Fourth Day of April, 2006

JON W. DUDAS
*Director of the United States Patent and Trademark Office*